US006523492B1

(12) United States Patent
Neckar et al.

(10) Patent No.: US 6,523,492 B1
(45) Date of Patent: Feb. 25, 2003

(54) ADJUSTABLE FOOT BRACE SYSTEM

(75) Inventors: Miroslav Neckar, Abbotsford (CA); Thomas R. Swetish, Racine, WI (US)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 09/921,648

(22) Filed: Aug. 3, 2001

(51) Int. Cl.[7] ..... B63B 35/00
(52) U.S. Cl. ..... 114/347; 114/363
(58) Field of Search ..... 114/343, 347, 114/363

(56) References Cited

U.S. PATENT DOCUMENTS

| | | | | |
|---|---|---|---|---|
| 468,211 | A | | 2/1892 | Sherman |
| 4,589,365 | A | | 5/1986 | Masters |
| 4,744,327 | A | | 5/1988 | Masters |
| 4,942,840 | A | | 7/1990 | Masters et al. |
| 4,943,051 | A | | 7/1990 | Haskins et al. |
| 5,367,976 | A | | 11/1994 | Van Schaik |
| 5,544,613 | A | * | 8/1996 | Scarborough et al. ..... 114/347 |
| 5,899,780 | A | | 5/1999 | Robbins |
| 5,957,355 | A | | 9/1999 | Swetish |
| 5,975,006 | A | | 11/1999 | Lewit |
| 6,003,454 | A | | 12/1999 | Ozers et al. |
| 6,035,799 | A | | 3/2000 | Lukanovich et al. |
| 2002/0005157 | A1 | * | 1/2002 | Knight ..... 114/347 |

* cited by examiner

*Primary Examiner*—Stephen Avila
(74) *Attorney, Agent, or Firm*—Foley & Lardner

(57) ABSTRACT

A foot brace system for use with a watercraft includes an elongated track, configured to be coupled to the watercraft, and a carriage. The track has the first one of a detent and a detent engaging surface. The carriage has a brace, which is slidably coupled to the track, and a retaining member that is carried by and pivotably coupled to the brace. The brace has a foot rest surface, and the retaining member has the second one of the detent and the detent engaging surface. The second one of the detent and the detent engaging surface pivots between a first position, in which the detent and the detent engaging surface are in engagement locking the carriage to the track, and a second position, in which the detent and the detent engaging surface are out of engagement allowing the carriage to be moved relative to the track.

34 Claims, 2 Drawing Sheets

FIG. 1
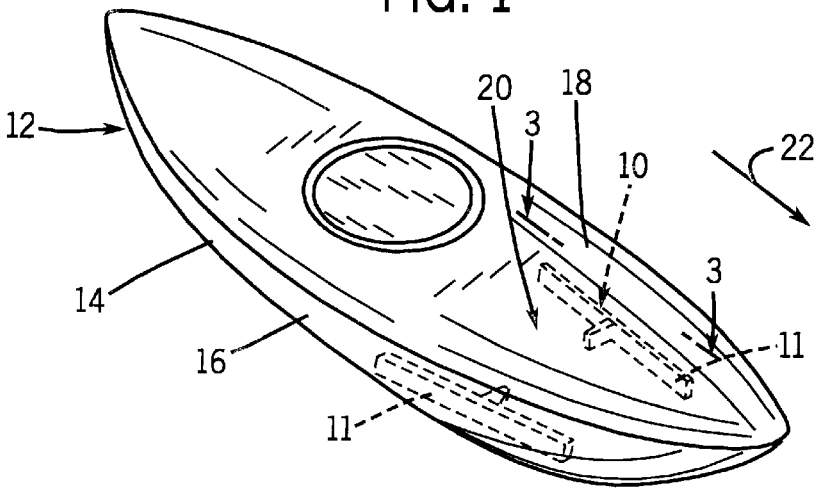
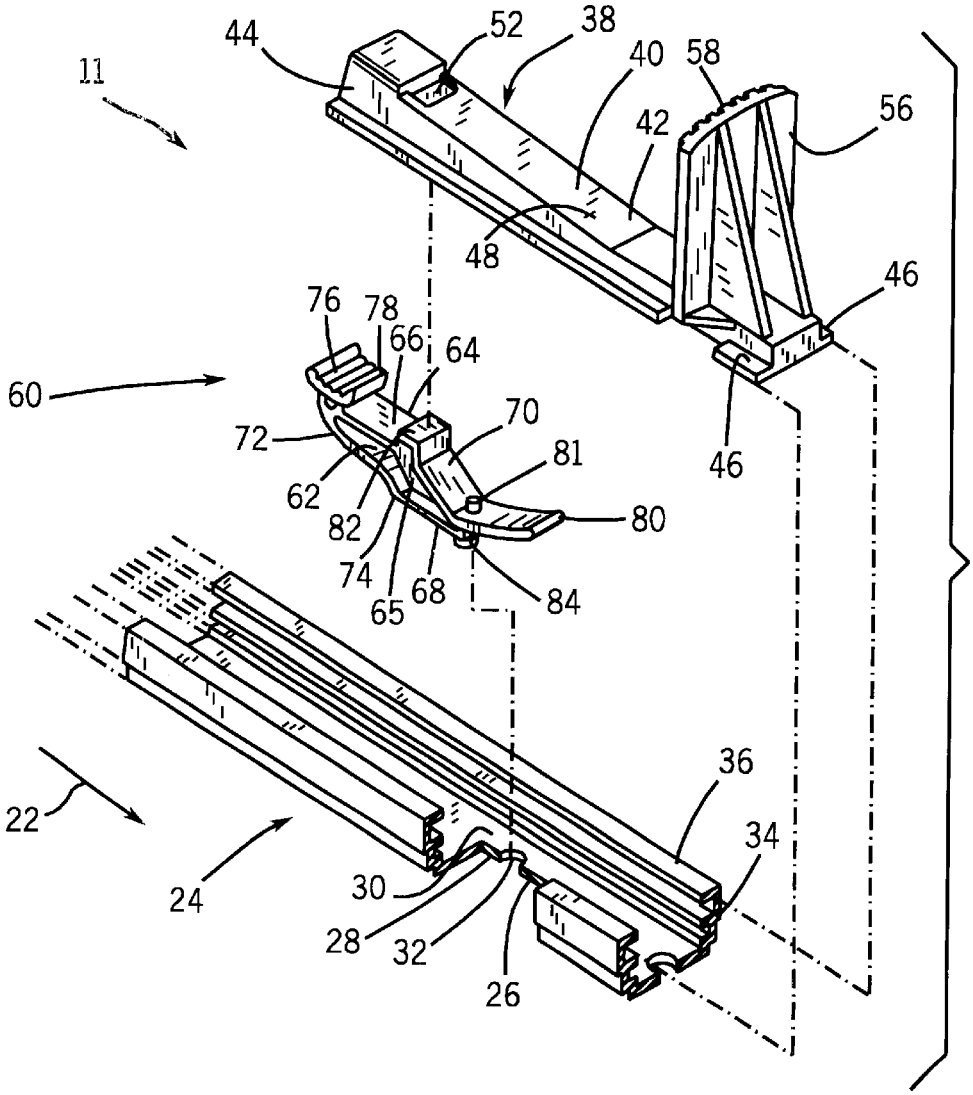
FIG. 2

ADJUSTABLE FOOT BRACE SYSTEM

FIELD OF THE INVENTION

The present invention relates generally to foot braces in individually powered water-going vessels. In particular, the present invention relates foot braces that can be adjusted between a plurality of positions by the occupant of the water-going vessel.

BACKGROUND OF THE INVENTION

Water-going crafts such as sit-in kayaks, sit-on-top kayaks, and canoes are frequently provided with foot braces or foot rests against which the user's foot applies a force as the user rows the kayak or canoe. Many conventional kayaks are formed by roto-molding and include integrally formed foot braces or foot rests (commonly known as foot wells). However, to accommodate the varying dimensions of different users, the kayaks require a multitude of foot wells along the longitudinal sides of the kayak. The multiple foot wells reduce the aesthetic attractiveness of the cockpit of the kayak and create a multitude of undesirable wells in which water can collect and which make cleaning the kayak more difficult. Moreover, such integrally formed wells are difficult if not impossible to form in single-walled structures such as canoes or sit-in kayaks.

As a result, canoes and sit-in kayaks typically employ a pair of adjustable foot braces or paddles. The foot braces or paddles are usually positioned on opposite sides of the craft and are each supported by a track. In order to adjust the position of the foot braces or paddles, the user is required to disengage a spring bias ratchet mechanism positioned behind, or on the far side of, the foot paddle or brace. Once this mechanism has been disengaged, the user can then reposition the foot brace or paddle to the desired location. Although a marked improvement over the integrally formed foot wells, the existing adjustable foot braces are problematic because they require multiple parts and are relatively complex. Moreover, they require the user to lean forward and reach over to the back side of the foot paddle or brace in order to disengage the mechanism and reposition the brace. Such adjustment is tedious and time consuming. It also requires the user to shift his or her weight, which increases the risk that the user will lose his or her balance and upset the craft. As a result, there is a continuing need for a simple and reliable adjustable foot brace system that allows a user to adjust the position of each foot brace without having to significantly shift his or her weight.

SUMMARY OF THE INVENTION

According to one exemplary embodiment, an adjustable foot brace system for use with a water-going vessel includes an elongated track that is configured to mount to the water-going vessel, a brace that is slidably coupled to the track and that has a foot rest surface, and a retaining member that is carried by the brace. The retaining member moves between an engaged and a disengaged position. In the engaged position, the retaining member retains the foot rest surface with respect to the elongated track. In the disengaged position, the brace is free to slide along the elongated track. In both positions, the foot rest surface faces the retaining member.

According to another exemplary embodiment, a watercraft includes a hull that forms a cockpit, at least one track that extends along the cockpit and that has the first one of a detent and a detent engaging surface, and a carriage that is slidably coupled to the at least one track. The carriage has a foot rest surface, a second one of the detent and the detent engaging surface that is coupled to the foot rest surface, and an actuation member that is coupled to the second one of the detent and the detent engaging surface. The foot rest surface faces the actuation member, which when actuated moves the detent and the detent engaging surface into and out of engagement with one another.

According to another exemplary embodiment, a foot brace system for use with a watercraft includes an elongated track configured to be coupled to the watercraft and a carriage. The track has the first one of a detent and a detent engaging surface. The carriage has a brace, which is slidably coupled to the track, and a retaining member that is carried by and pivotably coupled to the brace. The brace has a foot rest surface, and the retaining member has the second one of the detent and the detent engaging surface. The second one of the detent and the detent engaging surface pivots between a first position in which the detent and the detent engaging surface are in engagement locking the carriage to the track and a second position in which the detent and the detent engaging surface are out of engagement, allowing the carriage to be moved relative to the track.

According to another exemplary embodiment, an adjustable foot brace system for use with a water-going vessel includes only an elongated track that is configured to mount to the vessel, a brace that is slidably coupled to the elongated track and that has a foot rest surface, and a retaining member that is carried by the brace. The retaining member moves between an engaged position in which the retaining member retains the foot rest surface with respect to the elongated track and a disengaged position in which the brace is free to slide along the track. The foot rest surface faces the retaining member.

According to another exemplary embodiment, an adjustable foot brace system for use with a watercraft includes a brace that has a foot rest surface; a guide means for guiding movement of the foot rest surface between a plurality of positions; and a retaining means carried by the brace for releasably retaining the foot rest surface, which faces the retaining means, in a selected one of the plurality of positions.

BRIEF DESCRIPTION OF THE DRAWINGS

FIG. 1 is a perspective view of a kayak with an exemplary embodiment of an adjustable foot brace system of the present invention mounted to the inner surface of a hull of the kayak.

FIG. 2 is an exploded perspective view of the adjustable foot brace system of FIG. 1 with a section of the track cut away.

DETAILED DESCRIPTION OF THE PREFERRED EMBODIMENTS

Figure 3:
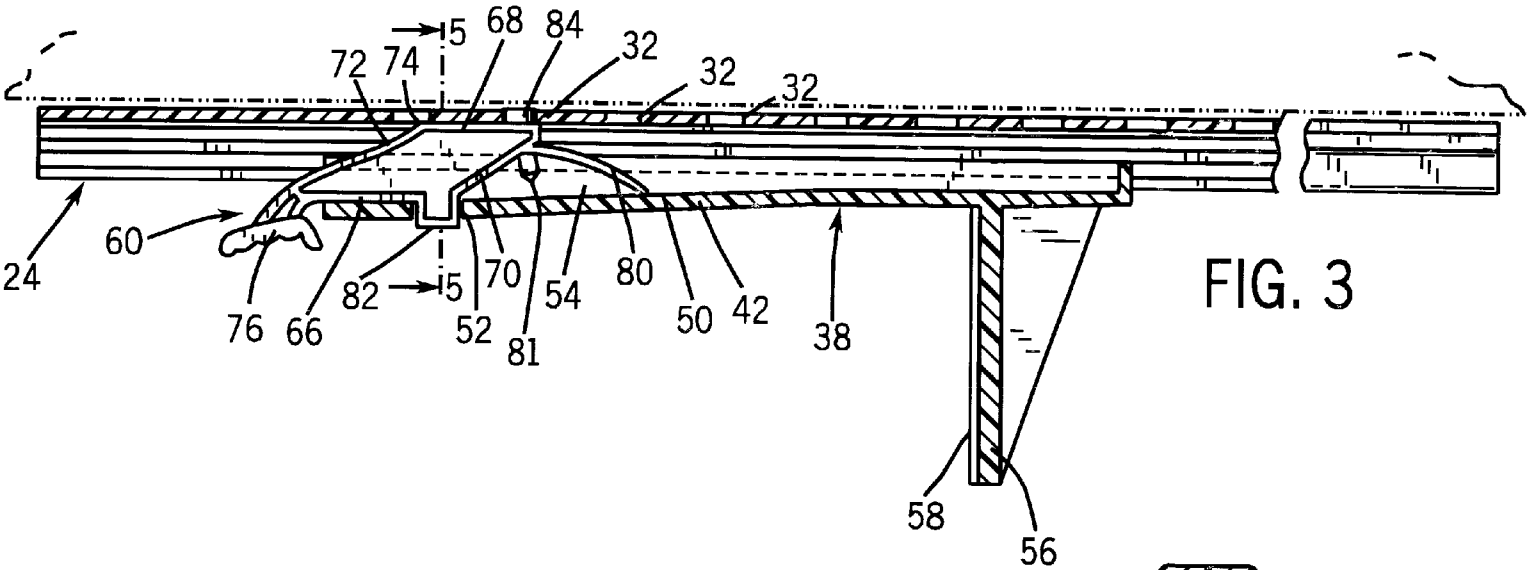
FIG. 3 is a sectional view of the system of FIG. 1 taken on line 3—3 illustrating a retaining member of the system in an engaged position.

FIG. 1 illustrates an adjustable foot brace system 10 consisting of two adjustable foot braces 11 mounted within a watercraft 12. Watercraft 12 includes a hull 14 that has an outer surface 16 and an inner surface 18. Outer surface 16 comes into contact with the water when watercraft 12 is in use, while inner surface 18 defines a cockpit 20 in which the individual or individuals providing the power to propel watercraft 12 can be seated. Watercraft 12, which does not make up part of adjustable foot brace system 10, can be any kind of manpowered, water-going vessel that is conventionally known in the art or which is hereafter developed. For purposes of the following description, the front and rear direction designations shall be defined with respect to the direction the individual or individuals powering watercraft 12 face when seated in watercraft 12, not with respect to the direction watercraft 12 travels. An arrow 22 in FIGS. 1 and 2 points in the direction the individuals will be facing when seated in watercraft 12, and therefore points towards the front.

FIG. 2 is a perspective view of adjustable foot brace 11 including a track 24, a brace 38, and a retaining member 60. Track 24 is an integrally molded elongated member that is configured to receive brace 38 and retaining member 60 and to allow them to slide along its length. Track 24 includes a base member 26 and two side walls 34. Base member 26 is a rigid, elongated panel that is mounted longitudinally to inner surface 18 by one of several methods that are well known in the art, such as by bolts or an adhesive. Base member 26 has a hull surface 28 and a detent surface 30, such that when base member 26 is mounted to hull 14, hull surface 28 faces or contacts inner surface 18 and detent surface 30 faces cockpit 20. Detent surface 30 includes a plurality of axially spaced detents 32 that are positioned at specified intervals along the length of base member 26. In one embodiment, detents 32 are circular holes that extend perpendicularly through base member 26. In other embodiments, detents 32 may be different sizes, shapes, and orientations, and may extend different depths into base member 26. In still other embodiments, detents 32 may be replaced by detent engaging surfaces, similar to a detent engaging surface 84 included on retaining member 60, that protrude from detent surface 30. In yet another embodiment, detents 32 may be notches that extend across the width of detent surface 30.

Side walls 34 protrude from the longitudinal edges of detent surface 30 and oppose each other. Each side wall 34 includes a U-shaped channel 36, such that channel 36 of one side wall 34 cooperates with channel 36 of the other side wall 34 to receive flanges 46 that are incorporated into brace 38 and to allow brace 38 to slide along the length of channels 36. In alternative embodiments of track 24 and brace 38, various other structures and mechanisms that are well known in the art may be used instead of the flange and channel configuration to guide and control brace 38 as it slides along the length of track 24.

Brace 38 and retaining member 60 cooperate to form carriage 61. Brace 38 is an integrally molded rigid member that provides a surface for the occupant to press or rest his or her foot against. Brace 38 includes a support structure 40 and a foot rest 56. Support structure 40 supports foot rest 56 and slidably couples to track 24. Support structure 40 includes a support panel 42, two side panels 44, and two flanges 46. Support panel 42 is a flat elongated panel that is about the same width as base member 26, but not as long. Support panel 42 has a cockpit surface 48 and a retainer surface 50 (shown in FIG. 3), where cockpit surface 48 faces cockpit 20 and retainer surface 50 faces hull 14. A rectangular opening 52 that cooperates with retaining member 60 is formed in support panel 42 proximate its rearmost end. Side panels 44 extend perpendicularly from the longitudinal edges of retainer surface 50, with the distance of the extension gradually increasing from the front to the rear most edge of support panel 42 so as to form a member with a non uniform U-shaped cross section. Flange 46, or what may also be referred to as a tongue, extends perpendicularly outward from the distal edge of each side panel 44 in a manner that allows flanges 46 to fit within channels 36 and that allows support structure 40 to slide along the length of track 24. When support structure 40 is coupled to track 24 in this way, a space 54 (shown in FIG. 3) is formed between support panel 42, side panels 44, base member 26, and side walls 34. In alternative embodiments, support structure 40 may be a multitude of different shapes and configurations and is not limited to those described above.

Foot rest 56 is a substantially flat and rigid panel that extends perpendicularly from cockpit surface 48, proximate its front edge, toward the center of cockpit 20. Foot rest 56 includes, on its rear most face, a foot rest surface 58 upon which the individual powering watercraft 12 can press his or her foot. Foot rest surface 58 is textured to prevent the individual's foot from easily slipping off. Foot rest 56 and foot rest surface 58 are both well known in the art and can have various shapes and configurations. Thus, they are not limited to the rectangular shape shown in FIG. 2.

Referring to FIGS. 2 and 3, retaining member 60 fits in space 54 and serves to regulate the position of brace 38 along track 24. Retaining member 60 is integrally molded and includes an actuation member 62 and a detent engaging surface 84. Actuation member 62 controls the movement of detent engaging surface 84 and includes a lever 64, a fulcrum 74, an actuation surface 76, a resilient element 80, a stopper 81, and a pivot projection 82. Lever 64 is substantially parallelogram shaped, having a first and a second pair of substantially parallel sides that define its border, where each side has a width sufficient to allow it to fit within space 54. A rigid panel 65 extends perpendicularly between each of the sides and serves to reinforce the structural integrity of lever 64. The first pair of sides, one of which being a brace side 66 and the other a track side 68, are spaced apart such that brace side 66 is proximate and generally parallel to retainer surface 50 and track side 68 is proximate and generally parallel to detent surface 30. The sides 66 and 68 are positioned in such a way that the front edge of brace side 66 is generally aligned with the rear edge of track side 68. The second pair of sides, one of which being a spring side 70 and the other a force side 72, extend between the respective edges of brace side 66 and track side 68, such that force side 72 extends between the rear edges of brace side 66 and track side 68, and spring side 70 extends between the front edges of brace side 66 and track side 68. In alternative embodiments, lever 64 may be any of a variety of different configurations. For example, lever 64 may be a flat, rigid member that extends diagonally between the rear edge of support structure 40 and a location on detent surface 30 that is somewhere in front of the rear edge of support structure 40. Lever 64 is alternatively made up of only track side 68 and force side 72, which would form a wide V-shape rather than the parallelogram described above. Similarly, lever 64 may be made up of only spring side 70 and brace side 66 to form a similarly wide V-shape that would be oriented in the opposite direction.

The intersections of brace side 66, spring side 70, track side 68, and force side 72 form four vertices. The vertex created by the intersection of force side 72 and track side 68 is fulcrum 74, around which lever 64 pivots. Fulcrum 74, which bears against detent surface 30, extends the width of the intersecting sides and creates the rotational axis of lever 64. In alternative embodiments, fulcrum 74 may bear against various surfaces. For example, in one embodiment, depending on the configuration of lever 64, fulcrum 74 may bear against retainer surface 50. In another embodiment, the fulcrum may not bear against any surface, but instead may be provided by a beam that extends between side panels 44.

Figure 4:
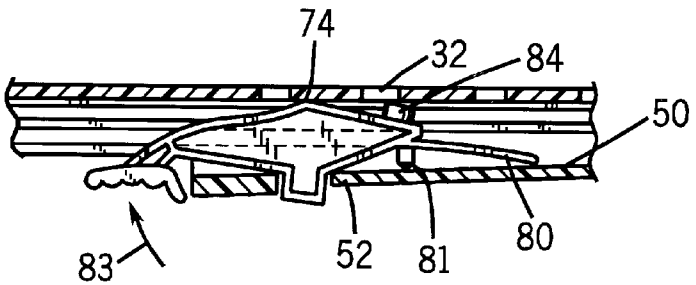
FIG. 4 is a fragmentary sectional view of the system of FIG. 1 taken on line 3—3 illustrating the retaining member in a disengaged position.

Referring to FIGS. 2–4, actuation surface 76 provides an area that allows the occupant of watercraft 12 to apply a force 83 to actuation member 62. Actuation surface 76 is formed proximate the vertex created by the intersection of force side 72 and brace side 66, and is therefore located on the rear side of fulcrum 74. In the preferred embodiment, actuation surface 76 is rectangular shaped, having a width substantially equal to that of support panel 42 and a length that is slightly greater than the width. Actuation surface 76 is a generally flat, textured surface that is slightly raised above, and substantially parallel to, brace side 66. Although generally flat, a raised lip 78 extends across the width of actuation surface 76 along its front edge. The shape and position of actuation surface 76 allow the occupant of watercraft 12 to apply force 83 with his or her foot or hand to lever 64. The application of this force to actuation surface 76 causes lever 64 to pivot or rotate around fulcrum 74. As illustrated in FIGS. 3 and 4, when retaining member 60 is coupled to brace 38, actuation surface 76 is situated beyond the rear edge of brace 38 as if actuation surface 76 was an extension of support panel 42. In alternative embodiments, actuation surface 76 may be a variety of different shapes, sizes, and configurations, and may be situated in different positions. For example, actuation surface 76 may be provided by a button, positioned on support panel 42 or on the rear end of brace 38, that interacts with retaining member 60 and causes it to rotate to the disengaged position when the button is pushed. Alternatively, surface 76 may be provided by a handle positioned on support panel 42 directly above the vertex created by the intersection of track side 68 and spring side 70, that causes the lever to rotate to the disengaged position when the occupant pulls on the handle.

Resilient element 80 is an elongated, flexible protrusion that extends generally from spring side 70, near the vertex created by the intersection of track side 68 and spring side 70, and presses against retainer surface 50. By pressing against retainer surface 50, resilient element 80 applies a force to lever 64 that is directed toward and substantially perpendicular to track 24, but it applies this force on the side of fulcrum 74 that is opposite the side on which the occupant of watercraft 12 may apply force 83 to actuation surface 76. Thus, resilient element 80 provides a biasing force that tends to counteract force 83 that may be applied by the occupant. Alternatively, resilient element 80 could be moved to the opposite vertex so that it would press against detent surface 30 and apply a force directed away from track 24. The force would then be acting on the same side of fulcrum 74 as force 83 that the occupant may apply, but it would be acting in the opposite direction. Although resilient element 80 is illustrated as an elongated protrusion, a multitude of various other structures may be used instead. For example, a compression spring may be situated between force side 72 and detent surface 30, or between spring side 70 and retainer surface 50. Alternatively, an extension spring is attached between actuation surface 76 and brace 38. Regardless of the structure used, resilient element 80 biases lever 64 toward a position in which track side 68 generally adjoins detent surface 30 and brace side 66 generally adjoins retainer surface 50.

A stopper 81 that extends outwardly from spring side 70 contacts retainer surface 50 when lever 64 is rotated to a certain point. This restricts the amount of possible rotation and thereby prevents any damage that may result from over rotation, such as overextending the resilient element. In alternative embodiments, stopper 81 may be situated in a number of different locations and may be one of a number of different shapes or configurations.

Pivot projection 82 is a step-like projection that extends from the vertex created by the intersection of brace side 66 and spring side 70. Pivot projection 82 stretches the width of lever 64 and extends outwardly in a direction perpendicular to brace side 66. As best shown in FIGS. 3 and 4, pivot projection 82 extends a sufficient distance away from brace side 66 to allow pivot projection 82 to engage opening 52. The engagement of pivot projection 82 and opening 52 allows actuation member 62 to rotate around fulcrum 74, and at the same time prevents linear motion of actuation member 62 with respect to brace 38.

Although less desirable, various other mechanisms or structures may be employed to pivotably support retaining member 60 in lieu of pivot projection 82 and fulcrum 74. For example, retaining member 60 may alternatively be pivotably pinned or hinged to brace 38. Retaining member 60 may also alternatively be integrally formed with brace 38 and be configured to pivot with respect to brace 38 by means of a living flexible hinge. Various other apparently known pivotal supporting structures and future developed pivotal supporting structures may be employed to enable retaining member 60 to pivot between the engaged and disengaged positions with respect to track 24.

Detent engaging surface 84 is preferably provided by a cylindrical protrusion that extends perpendicularly from track side 68 proximate its front edge and that engages one of the plurality of detents 32 provided on detent surface 30. The engagement of detent 32 and detent engaging surface 84 locks the linear position of retaining member 60 with respect to track 24. In alternative embodiments, detent engaging surface 84 may be a different size, shape, or orientation, as long as it is compatible with detents 32. In other alternative embodiments, a detent similar to detent 32 may be provided on retaining member 60 and detent engaging surfaces similar to detent engaging surface 84 may be provided on detent surface 30. In still another alternative embodiment, detent engaging surface 84 may be a notch that extends across the width of track side 68.

Figure 5:
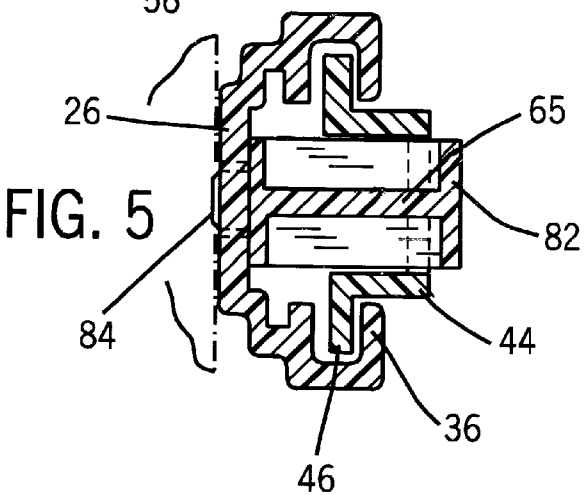
FIG. 5 is a sectional view of the system of FIG. 3 taken on line 5—5.

As shown by FIG. 3, resilient element 80 biases retaining member 60 toward the engaged position in which both the front and rear edges of track side 68 generally adjoin detent surface 30. In the engaged position, detent engaging surface 84 engages one of the plurality of detents 32 provided in track 24. In the engaged position, linear movement of retaining member 60 with respect to track 24 is prevented. As best illustrated in FIGS. 3–5, retaining member 60 fits in space 54 formed between brace 38 and track 24 and is situated so that pivot projection 82 extends through opening 52 and actuation surface 76 extends beyond the rear edge of brace 38. When retaining member 60 is in the engaged position (shown in FIGS. 3 and 5), the engagement of detent 32 and detent engaging surface 84 locks the linear position of retaining member 60 with respect to track 24, and the engagement of pivot projection 82 with opening 52 locks the linear position of brace 38 with respect to retaining member 60. Thus, when retaining member 60 is in the engaged position, foot rest surface 58 provided by brace 38 is locked in place.

As shown by FIG. 4, when the occupant of watercraft 12 applies force 83 to actuation surface 76 (assuming force 83 is sufficient in magnitude to overcome the opposing force provided by resilient element 80), actuation surface 76 moves toward track 24 and causes actuation member 62 to rotate around fulcrum 74. This rotation causes the front edge of track side 68 to move away from detent surface 30 and thereby removes detent engaging surface 84 from detent 32. When retaining member 60 is rotated enough to completely remove detent engaging surface 84 from detent 32, retaining member 60 is then in a disengaged position (shown in FIG. 4). In the disengaged position, retaining member 60 can move freely along the length of track 24, the movement restricted only by the friction between fulcrum 74 and detent surface 30 upon which fulcrum 74 bears.

When the occupant applies a force sufficient to rotate retaining member 60 to the disengaged position, he or she is then able to freely slide foot rest surface 58 to one of the plurality of possible positions along track 24 where detent engaging surface 84 aligns with one of the plurality of detents 32. Once foot rest surface 58 is in the desired location, the occupant can release the force and allow the biased retaining member 60 to return to the engaged position, where the location of foot rest surface 58 will once again be locked with respect to track 24.

In the preferred embodiment, track 24, retaining member 60, and brace 38 are each integrally molded out of plastic. However, in alternative embodiments, each of the three components may be constructed from a wide variety of suitable materials, such as aluminum or other metals. The ultimate selection of materials will of course depend on cost, performance characteristics, performance requirements, and numerous other factors.

In the preferred embodiment, adjustable foot brace 11 is made up of three separate components: track 24, retaining member 60, and brace 38. In an alternative embodiment, retaining member 60 and brace 38 may be integrally formed as a single unitary body to form carriage 61. Similarly, in alternative embodiments, the individual elements of each component may be manufactured separately from the primary component to which they are attached. For example, foot rest 56 may be manufactured as a separate piece and then attached to brace 38.

In the preferred embodiment, adjustable foot brace system 10 includes a pair of adjustable foot braces 11 mounted in front of the occupant on opposite sides of watercraft 12. In this configuration, each foot rest 56 points generally toward the lateral center of watercraft 12 and allows the occupant to place one foot on each foot rest 56. In an alternative embodiment, adjustable foot brace system 10 may include only one adjustable foot brace 11 mounted in front of the occupant either on the bottom of cockpit 20, on the top of cockpit 20 if watercraft 12 has an enclosed cockpit 20 or some other supporting structure, or on either side of cockpit 20. In this configuration, each foot rest 56 would point generally toward the lateral center of watercraft 12 and would allow the occupant to place both of his or her feet on foot rest 56. If more than one person powers watercraft 12, an adjustable foot brace system can be mounted in front of each person.

In alternative embodiments of adjustable foot brace system 10, the functions of interacting parts may be reversed. For example, rather than brace 38 or the carriage having flanges 46 and track 24 having channels 36, brace 38 or the carriage may have the channels while track 24 has the flanges. Similarly, track 24 may include a plurality of axially spaced detent engaging surfaces instead of detents 32 while retaining member 60 includes a detent rather than detent engaging surface 84. As a final example, track 24 may include a single detent 32 (or a single detent engaging surface) rather than a plurality of detents 32 (or detent engaging surfaces) while retaining member 60 includes a plurality of mating detent engaging surfaces 84 (or detents) rather than a single detent engaging surface 84 (or detent).

In alternative embodiments of adjustable foot brace system 10, structures other than elongated track 24 may be used to guide brace 38 or the carriage. For example, rather than having an elongated track 24, only several small portions of track 24 could be mounted to hull 14. These small portions of a track 24, when sufficient in number and properly spaced, could then guide the carriage or brace in the same way an elongated track would guide them. Instead of having a plurality of detents or detent engaging surfaces on an elongated track, one of the small portions of track 24 would have a single detent or detent engaging surface while retaining member 60 carried by brace 38 would include a plurality of detents or detent engaging surfaces that would engage the one detent or detent engaging surface of the small portion of track 24.

In alternative embodiments of adjustable foot brace system 10, track 24 and brace 38 (or the carriage) may utilize various mechanisms and structures other than a tongue and channel mechanism to guide brace 38 along track 24. For example, track 24 may include two parallel rods that run the length of track 24. Brace 38 could then be configured to accept the rods, which would guide it as it slides along track 24. Alternatively, track 24 may include a pair of cooperating channels that are configured to receive rollers, rather than flanges, that are mounted to side panels 44 of brace 38. In addition to the these two alternatives, there are a multitude of other configurations and structures that may be used that also fall within the scope of the present invention.

In alternative embodiments of adjustable foot brace system 10, brace 38 may engage retaining member 60 through the use structures other than opening 52 and pivot projection 82. For example, a pin may be used that would extend through brace 38 and retaining member 60 and would lock the linear position of retaining member 60 with respect to brace 38 while at the same time allowing retaining member 60 to rotate around fulcrum 74. Alternatively, brace side 66 could be rigidly mounted to support panel 42, and the portion of support panel 42 that brace side 66 was attached to could be configured to flex as needed to accommodate the rotation of retaining member 60. The amount of flex could be controlled by adjusting the thickness of support panel 42, by changing the material out of which support panel 42 is made, or by cutting support panel 42 around three sides of the rectangular shaped brace side 66 so as to effectively create a resilient portion of support panel 42 that would flex around the intact side.

In alternative embodiments of adjustable foot brace system 10, actuation member 62 may be a device other than lever 64. For example, actuation member 62 may include a wedge or tapered beam and a device adapted to receive the wedge, where the receiving device would include a detent (or detent engaging surface). The wedge and receiving device could be configured such that when the occupant pushed the wedge toward the receiving device, the receiving device would climb the incline of the wedge and would remove the detent (or detent engaging surface) from engagement with the mating detent engaging surface (or detent).

One primary advantage of the invention described above is that it allows the occupant to easily adjust the position of the foot brace without having to bend way over to reach behind the foot rest. Another primary advantage of the invention is its simple construction, which, when compared to other systems, reduces the required maintenance and increases the durability and reliability. Overall, the advantage of the adjustable foot brace system 10 is that it provides a simple, convenient, and reliable way for occupants to adjust the positions of their foot rests.

Although the present invention has been described with reference to preferred embodiments and several alternative embodiments, workers skilled in the art will recognize that changes may be made in form and detail without departing from the spirit and scope of the invention. The present invention described with reference to the preferred and alternative embodiments and set forth in the following claims is manifestly intended to be as broad as possible. For example, unless specifically otherwise noted, the claims reciting a single particular element also encompass a plurality of such particular elements.

What is claimed is:

1. An adjustable foot brace system for use with a water-going vessel, the system comprising:

an elongated track configured to mount to the vessel;

a brace slidably coupled to the elongated track, the brace having a foot rest surface; and a retaining member carried by the brace, wherein the retaining member moves between an engaged position in which the retaining member retains the foot rest surface with respect to the elongated track and a disengaged position in which the brace is free to slide along the track and wherein the foot rest surface faces the retaining member;

wherein the track includes a first one of a pair of parallel channels and a pair of tongues received within the channels and wherein the brace includes the second one of a pair of parallel channels and a pair of tongues received within the pair of channels.

2. The system of claim 1, wherein the retaining member pivots between the engaged position and the disengaged position.

3. The system of claim 2, wherein the retaining member includes a fulcrum about which the retaining member pivots.

4. The system of claim 3, wherein the fulcrum bears against the track.

5. The system of claim 2, wherein the retaining member is resiliently biased towards the engaged position.

6. The system of claim 1, wherein the retaining member is resiliently biased towards the engaged position.

7. The system of claim 1, wherein the retaining member includes an actuation surface configured to move the retaining member between the engaged position and the disengaged position and wherein the foot rest surface faces the actuation surface.

8. The system of claim 7, wherein the retaining member includes a lever providing the actuation surface.

9. An adjustable foot brace system for use with a water-going vessel, the system comprising:

an elongated track configured to mount to the vessel;

a brace slidably coupled to the elongated track, the brace having a foot rest surface; and a retaining member carried by the brace, wherein the retaining member moves between an engaged position in which the retaining member retains the foot rest surface with respect to the elongated track and a disengaged position in which the brace is free to slide along the track and wherein the foot rest surface faces the retaining member;

wherein the retaining member pivots about an axis between the engaged position and the disengaged position, wherein the retaining member includes a resilient element on a first side of the axis and wherein the retaining member includes an actuation surface on a second opposite side of the axis.

10. The system of claim 9, wherein the track includes a first one of a detent and a detent engaging surface, and wherein the retaining member includes a second one of a detent and detent engaging surface on the first side of the axis.

11. The system of claim 9, wherein the retaining member is captured between the brace and the track.

12. The system of claim 9 wherein the detents are circular holes.

13. The system of claim 9 wherein the resilient member is a resiliently flexible spring.

14. The system of claim 9 wherein further comprising a stopper extending outwardly from the retaining member and configured to restrict the amount of rotation of the retaining member.

15. The system of claim 9, wherein the retaining member includes an actuation surface configured to move the retaining member between the engaged position and the disengaged position and wherein the foot rest surface faces the actuation surface.

16. The system of claim 15, wherein the retaining member includes a lever providing the actuation surface.

17. A watercraft comprising:

a hull forming a cockpit;

at least one track extending along the cockpit, the at least one track including a first one of a detent and a detent-engaging member; and a carriage slidably coupled to the at least one track, the carriage including:

a foot rest surface;

a second one of the detent and the detent engaging surface coupled to the foot rest surface; and an actuation member coupled to the second one of the detent and the detent engaging surface, wherein actuation of the actuation member moves the detent and the detent engaging surface into and out of engagement with one another and wherein the foot rest surface faces the actuation member;

a brace providing the foot rest surface; and a retaining member providing said second one of the detent and the detent engaging surface and the actuation member, wherein the retaining member moves between an engaged position in which said second one of the detent and the detent engaging surface is in engagement with the first one of the detent and the detent engaging surface and a disengaged position in which said second one of the detent and detent-engagement surface is out of engagement with the first one of the detent and the detent-engagement surface;

wherein the retaining member pivots about an axis between the engaged position and the disengaged position, wherein the retaining member includes a resilient element on a first side of the axis and wherein the retaining member includes an actuation surface on a second opposite side of the axis.

18. The watercraft of claim 17, wherein the track is mounted to the hull.

19. The watercraft of claim 17, wherein the track includes a first one of a detent and a detent engaging surface, and wherein the retaining member includes a second one of a detent and detent engaging surface on the first side of the axis.

20. A watercraft comprising:

a hull forming a cockpit;

at least one track extending along the cockpit, the at least one track including a first one of a detent and a detent-engaging member; and a carriage slidably coupled to the at least one track, the carriage including:

a foot rest surface;

a second one of the detent and the detent engaging surface coupled to the foot rest surface; and an actuation member coupled to the second one of the detent and the detent engaging surface, wherein actuation of the actuation member moves the detent and the detent engaging surface into and out of engagement with one another and wherein the foot rest surface faces the actuation member;

wherein the track includes a first one of a pair of parallel channels and a pair of tongues received within the channels and wherein the carriage includes the second one of a pair of parallel channels and a pair of tongues received within the pair of channels.

21. The watercraft of claim 20, wherein the carriage includes:

a brace providing the foot rest surface; and a retaining member providing said second one of the detent and the detent engaging surface and the actuation member, wherein the retaining member moves between an engaged position in which said second one of the detent and the detent engaging surface is in engagement with the first one of the detent and the detent engaging surface and a disengaged position in which said second one of the detent and detent-engagement surface is out of engagement with the first one of the detent and the detent-engagement surface.

22. The watercraft of claim 21, wherein the retaining member pivots between the engaged position and the disengaged position.

23. The watercraft of claim 22, wherein the retaining member includes a fulcrum about which the retaining member pivots.

24. The watercraft of claim 23, wherein the fulcrum bears against the track.

25. The watercraft of claim 22, wherein the retaining member is resiliently biased towards the engaged position.

26. The watercraft of claim 21, wherein the retaining member is resiliently biased towards the engaged position.

27. The watercraft of claim 21, wherein the retaining member includes a lever providing the actuation member.

28. The watercraft of claim 21, wherein the retaining member is captured between the brace and the track.

29. The watercraft of claim 20, wherein the foot rest surface and the actuation member are provided by distinct components coupled to one another.

30. The system of claim 20, wherein the pair of tongues are a pair of flanges.

31. The watercraft of claim 20, wherein the carriage includes:

a brace providing the foot rest surface; and a retaining member providing said second one of the detent and the detent engaging surface and the actuation member, wherein the retaining member moves between an engaged position in which said second one of the detent and the detent engaging surface is in engagement with the first one of the detent and the detent engaging surface and a disengaged position in which said second one of the detent and detent-engagement surface is out of engagement with the first one of the detent and the detent-engagement surface.

32. A foot brace system for use with a watercraft, the system comprising:

an elongated track configured to be coupled to a watercraft, the track having a first one of a detent and a detent engaging surface; and a carriage including:

a brace slidably coupled to the track, the brace including a foot rest surface; and a retaining member carried by the brace and pivotably coupled to the brace, the retaining member including a second one of the detent and the detent engaging surface, wherein the second one of the detent and the detent engaging surface pivots between a first position in which the detent and the detent engaging surface are in engagement locking the carriage to the track and a second position in which the detent and the detent engaging surface are out of engagement allowing the carriage to be moved relative to the track;

wherein the retaining member is captured between the brace and the track.

33. The foot brace system of claim 32, wherein the foot rest surface faces the retaining member.

34. An adjustable foot brace system for use with a watercraft, the system comprising:

a brace including a foot rest surface;

guide means for guiding movement of the foot rest surface between a plurality of positions; and retaining means carried by the brace for releasably retaining the foot rest surface in a selected one of the plurality of positions, wherein the foot rest surface faces the retaining means;

wherein the guide means includes a first one of a pair of parallel channels and a pair of tongues received within the channels and wherein the brace includes the second one of a pair of parallel channels and a pair of tongues received within the pair of channels.

* * * * *